US005558133A

United States Patent [19]

Bortoli et al.

[11] Patent Number: 5,558,133

[45] Date of Patent: Sep. 24, 1996

[54] FILL END CATCHING/CLAMPING SYSTEM IN THE DRIVE CLAMP OF A LOOM

[75] Inventors: Giulio Bortoli, Schio; Luciano Corain, Vicenza, both of Italy

[73] Assignee: Nuovo Pignone S.p.A., Florence, Italy

[21] Appl. No.: 509,939

[22] Filed: Aug. 1, 1995

[30] Foreign Application Priority Data

Aug. 5, 1994 [IT] Italy ..... MI94A1709

[51] Int. Cl.[6] ..... D03D 47/20

[52] U.S. Cl. ..... 139/448; 24/130

[58] Field of Search ..... 139/170.3, 448, 139/447; 24/130

[56] References Cited

U.S. PATENT DOCUMENTS

| | | | |
|---|---|---|---|
| 546,084 | 9/1895 | Webb | 24/130 |
| 4,129,155 | 12/1978 | Merisio | 139/448 |
| 4,739,805 | 4/1988 | Kohler | 139/448 |
| 5,129,431 | 7/1992 | Stacher | 139/448 |
| 5,341,852 | 8/1994 | Corain et al. | 139/448 |
| 5,348,057 | 9/1994 | Corain et al. | 139/448 |

FOREIGN PATENT DOCUMENTS

| | | |
|---|---|---|
| 0233142 | 8/1987 | European Pat. Off. . |
| 0504899 | 9/1992 | European Pat. Off. . |
| 0571025 | 11/1993 | European Pat. Off. . |
| 0576074 | 12/1993 | European Pat. Off. . |
| 2464319 | 3/1981 | France . |
| 2083844 | 3/1982 | United Kingdom . |

*Primary Examiner*—Andy Falik

*Attorney, Agent, or Firm*—Oblon, Spivak, McClelland, Maier, & Neustadt, P.C.

[57] ABSTRACT

A fill end catching/clamping system in a fill drive clamp body provided at one end with a hook. A wedge is designed to axially move inside the hook. A wall of the wedge cooperates with a wall of said hook to form a "V"-shaped hollow in which the fill end is clamped. At least one elastic blade, positioned below the wedge, has a side wall that cooperates with the wall of the hook which forms one side of the "V"-shaped hollow to assist in retaining the fill end or ends in the "V"-shaped hollow.

7 Claims, 3 Drawing Sheets

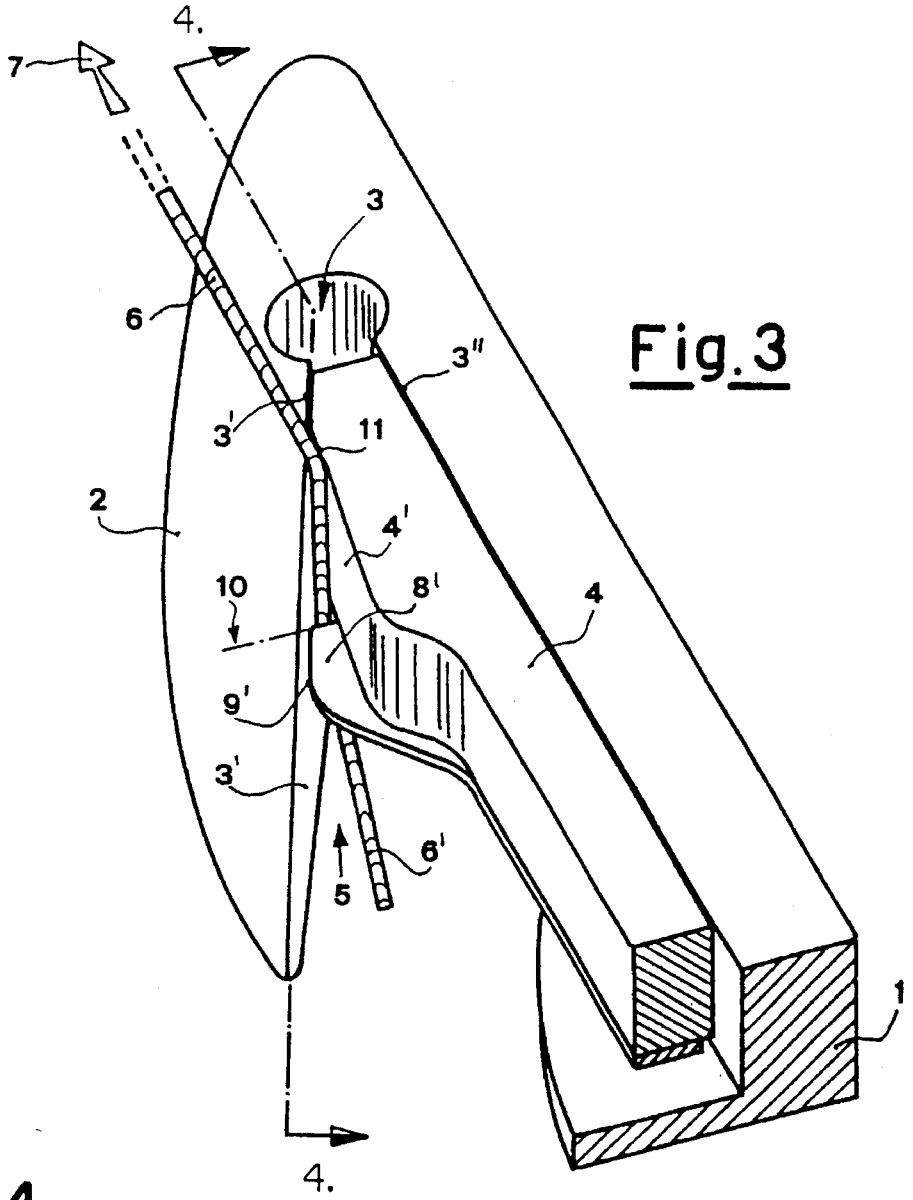
Fig.3
Fig.4
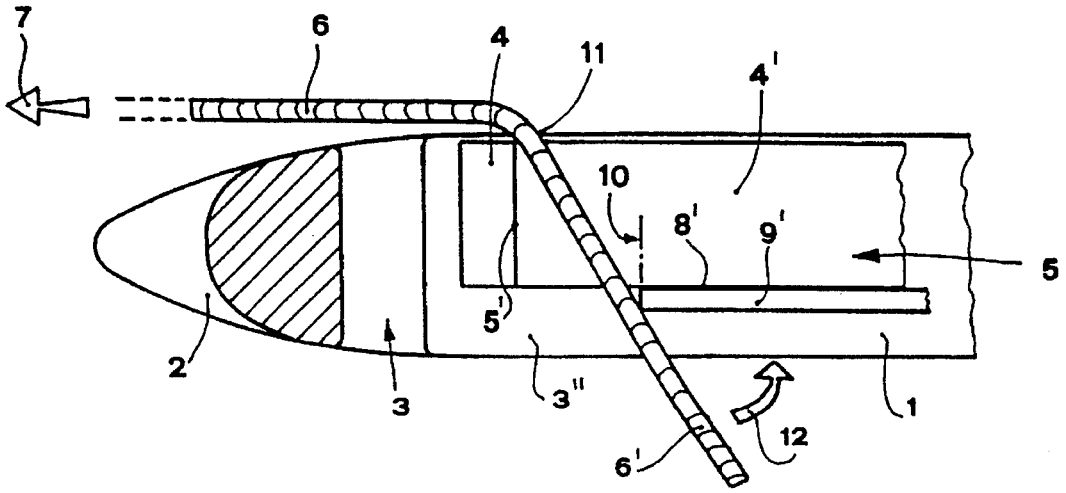

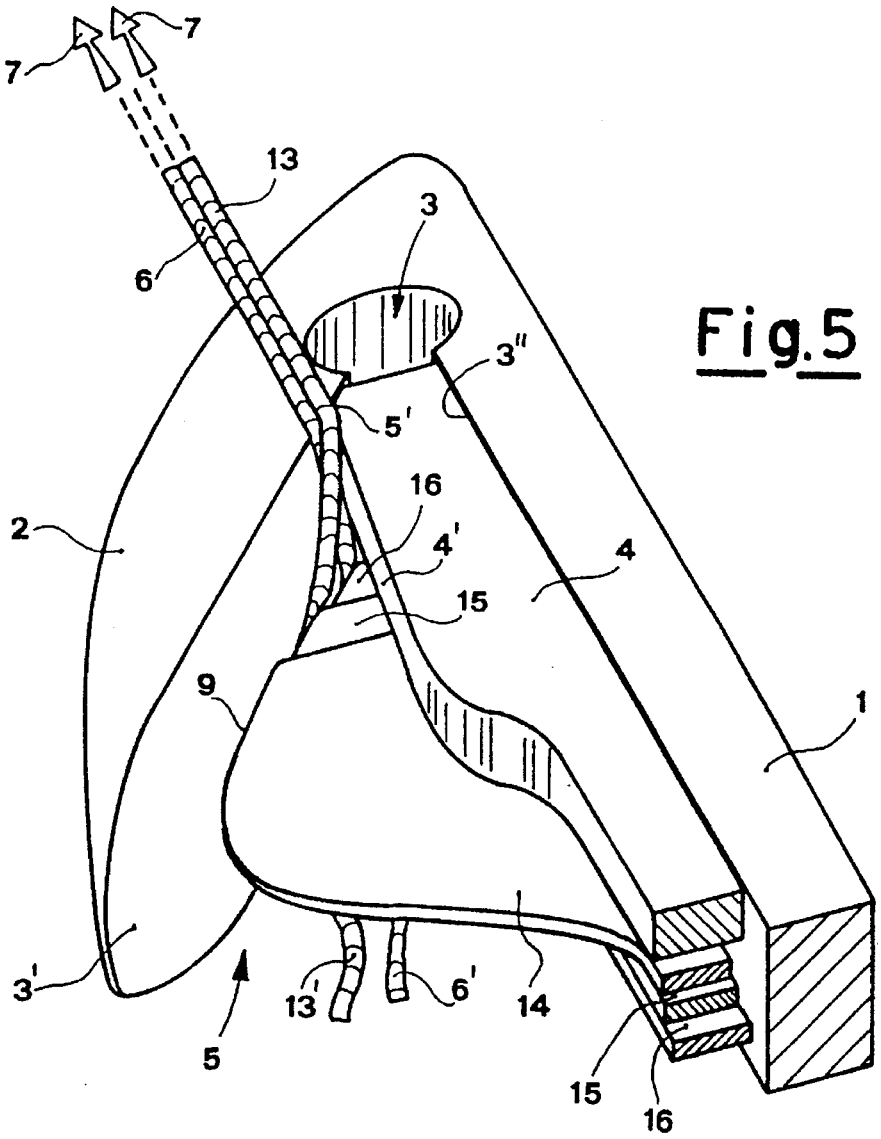
Fig.5
Fig.6
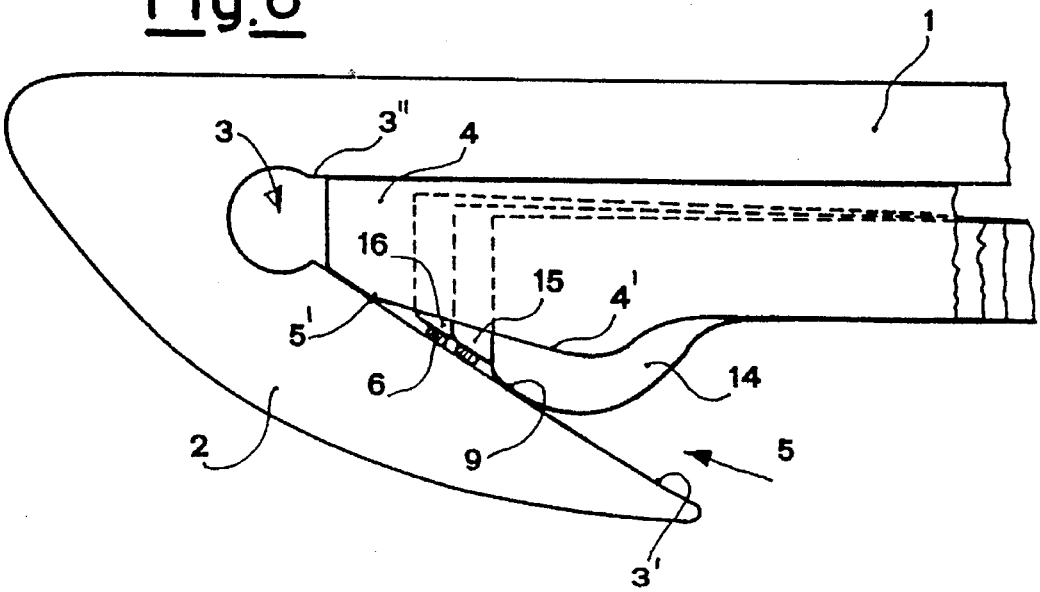

FILL END CATCHING/CLAMPING SYSTEM IN THE DRIVE CLAMP OF A LOOM

The present invention relates to a new system for fill ends catching/clamping which, by using at least one elastic blade cooperating, with a side wall thereof with that wall of the hook which forms the "V"-shaped hollow inside which the fill ends are lock-clamped, of the fill drive clamp, makes it possible one or more fill ends to be more effectively clamped simultaneously, with no risks that any of said fill ends get lost during the drive, even at the high operating speeds of present looms, as well as the fill ends to be reliably released as said fill drive clamp gets disengaged from the edge of the fabric which is being manufactured.

More specifically, the present invention relates to an improvement in the fill end catching/clamping organs of the fill drive clamp which is the subject-matter of Italian patent application no. MI92 A 001534, filed by the present Applicant on Jun. 23rd, 1992.

In said patent application, the catching/clamping organs of the fill drive clamp are substantially constituted by an axially mobile wedge kept elastically urged inside a hook provided at an end of the clamp body, with which it forms, on one side, a narrow "V"-shaped hollow for lock-clamping the fill end to be driven entered in it which is also kept elastically urged by an elastic blade fastened, at its rear end, onto the bottom surface of said mobile wedge or said clamp body, against a bottom shoulder means provided on the bottom outer surface of said hook.

In that way the fill end, besides getting lock-clamped inside said "V"-shaped hollow and being additionally clamped by said elastic blade, is also obliged to undergo sharp direction changes, nearly at a right angle, respectively at its getting engaged by, and at its getting released from, said bottom shoulder means of the hook, which theoretically provides an excellent resistance to it being unslid from clamp top.

Actually, such a solution known from the prior art is affected by drawbacks, the main of which is that, with said elastic blade being kept constantly urged against said bottom shoulder means of the hook during the whole stroke of the wedge for fill end disengagement, when said fill drive clamp gets disengaged from the edge of the fabric which is being manufactured, a dangerous friction is retained between said blade and the fill end, which may cause an irregular disengagement of said fill end from said clamp to take place, with a further amount of fill end being unwound from the relevant feed cop, and consequently a waste of fill yarn arising.

Another drawback consists then in that said solution does not allow a reliable clamping to occur in case of a plurality of fill ends simultaneously entering the fill drive clamp, because it is not capable of providing a selective fill end catching, and furthermore the unavoidable vibrations of the elastic blade during the clamp stroke, by causing the load on driven fill end, and consequently the clamping effect, to change, do not secure that the fill end will not get unslid from top, with the fill end being consequently prone to get released by rotating around its top clamping point.

The purpose of the present invention precisely is of obviating the above said drawbacks and therefore supplying a fill end catching/clamping system for a fill drive clamp of the type in which a wedge is designed to axially move inside a hook, which makes sure that the fill end will not get unslid during the drive, and that said fill end will not be damaged by slipping and which furthermore allows not only an easy immediate release to occur of the fill end when the clamp leaves the edge of the fabric which is being manufactured, but also a reliable and effective drive of a plurality of fill ends simultaneously.

The above purpose is substantially accomplished in that the fill end which gets locked inside the narrow "V"-shaped hollow bounded by a wall of the axially movable wedge and the hook wall facing said wedge wall, is also awastically retained, upstream said lock clamping, by at least one elastic blade a side wall of which cooperates with said wedge wall.

In that way, in fact, the fill end being urged against the hook wall by the side wall of the blade causes an additional clamping to occur of the fill end which, by not being affected by the vibrations of the fill drive clamp, reliably prevents any unsliding of the fill end from the top of said clamp, which could occur owing to said fill end rotating around its upper point of lock clamping, during the whole stroke of said clamp; on the other hand, as soon as the wedge is axially moved, it is evident that the fill end will result to be completely free of getting released from the fill drive clamp, with no danger of getting damaged.

Summing up, the fill end catching/clamping system in the fill drive clamp of a loom, in which an axially moving wedge kept elastically urged inside a hook provided at one end of the clamp body, bounds with a wall thereof, and the wall of the said hook which is facing said wedge wall, a narrow "V"-shaped hollow for lock-clamping the fill end to be driven entered in said hollow, is characterized, according to the present invention, in that at least one elastic blade extends along said "V"-shaped hollow, up to the apex of said "V"-shape, or beyond said apex, to cooperate, with a side wall thereof, with said wall of said hook.

Then, according to a preferred embodiment of the present invention, said elastic blade is supported by said axially movable wedge, but it is clear that it can also be supported by the same clamp body.

On the other hand, if the fill end to be driven gives is of stiff type, as well known in the art, on it the application of an additional blade clamping would not really be very effective because the stiffness of the fill end would not prevent the latter from sliding along the clamping zone up to exit it; in this case, according to a different embodiment of the present invention, a short elastic blade is used which does not extend up to reach the apex of said "V"-shaped hollow, but ends before reaching said apex, which blade does not engage the stiff fill end to be driven by clamping it; said rigid fill end to be driven gets locked between said apex of said "V"-shaped hollow and said short elastic blade; and said short elastic blade, coming to rest against said hook wall, only acts as a rear hindrance to the stiff fill end getting released, which would otherwise be possible, by a rotary movement of said stiff fill end around its top lock clamping point.

Finally, according to a further embodiment of the present invention, said elastic blade is constituted by a stack of mutually superimposed elastic laminae having different lengths from each other and increasing towards said apex of said "V"-shaped hollow.

Inasmuch as the latter embodiment causes the clamping action of each individual lamina to be exploited to clamp a specific fill, it results particularly advantageous when a plurality of fill ends have to be driven simultaneously; on the other hand, the unfailing presence, in the rear portion behind a locked/clamped fill end to be driven, of at least one lamina which, by getting to rest against said active wall of the hook, constitutes an unsormountable barrier, preventing said fill end from rotating around its upper lock clamping point, will make sure against the fill end getting unslid precisely owing to its rotation.

The present invention will be better explained now by reference to the accompaning drawings which display preferred embodiments supplied for merely exemplified, non-limitative purposes, because technical or structural modifications may always be supplied without departing from the scope of the present invention.

In said drawings:

FIG. 3 shows a perspective view of the hook end of a fill drive clamp using the fill end catching/clamping system according to an embodiment of the invention;

FIG. 4 shows a cross sectional view made along line BB of FIG. 3;

FIG. 5 shows a perspective view of the hook end of a fill drive clamp using the fill end catching/clamping system according to a further embodiment of the invention;

FIG. 6 shows a top view of the hook end of the fill drive clamp of FIG. 5 in which, for clearness'sake, the fill ends leaving said clamp are not displayed.

Figure 1:
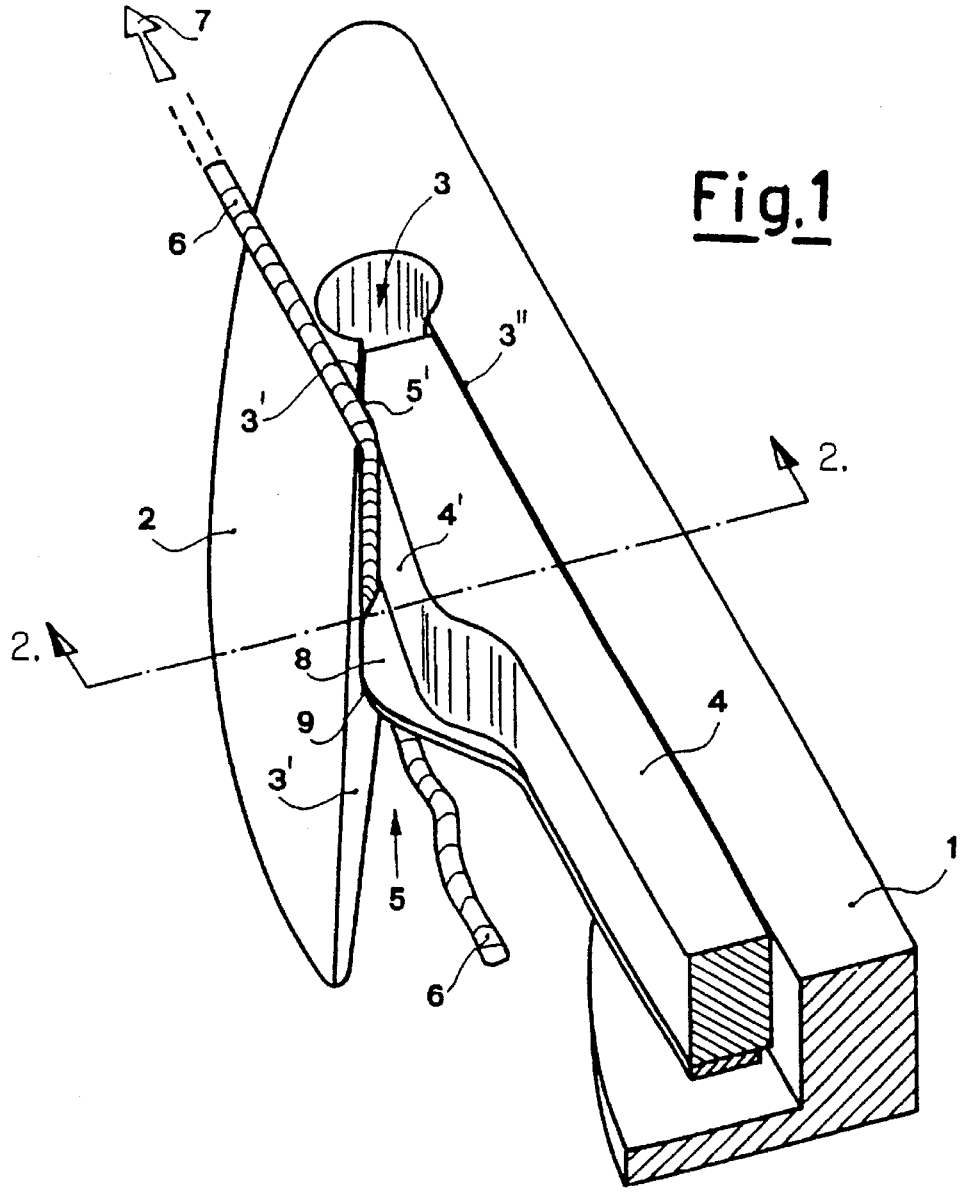
FIG. 1 shows a perspective view of the hook end of a fill drive clamp using the fill end catching/clamping system according to the present invention.
Figure 2:
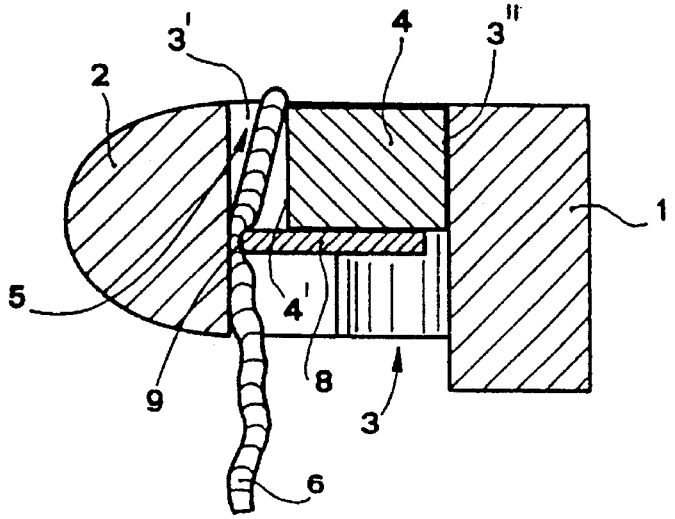
FIG. 2 shows a cross sectional view made along line AA of FIG. 1.

Referring to the figures, with (1) the front end is indicated of the fill drive clamp body of a loom, which ends into a hook (2) which generates a hollow (3) against whose side walls (3') and (3") an axially moving wedge (4) is kept elastically urged. On one side thereof, said wedge (4) generates, with its side wall (4') facing said wall (3') of the hollow (3) of said hook (2) and said wall (3'), a narrow "V"-shaped hollow (5) inside which the fill end (6) enters and gets locked which, coming from the feed cop not displayed in the accompanying Figures, is tensile stressed in the direction of arrow (7). Said fill end (6) is furthermore also kept elastically urged against said wall (3') of hook (2) by an elastic blade (8) which, by being supported by said wedge (4) at its rear end (not displayed in the accompanying Figures) of the bottom wall of which it is fastened onto, extends along said "V"-shaped hollow (5) up to reach the apex (5') of said "V" shape, with its side wall (9) extending to cooperate with said wall (3').

In that way, when said fill end (6) enters the hollow (5), its thickness elastically shifts the blade (8) causing it to move away from wall (3'), and the fill end (6) continues to penetrate the hollow (5), until it gets locked; now, the fill end (6) results in being locked in position both due to the effect of the lock engagement, and owing to the effect of pressure applied by the side wall (9) of the elastic blade (8), which evidently confers to it a considerable resistance to getting unslid from top according to the direction of arrow (7). On the other hand, as soon as the wedge (4) is moved backwards together with blade (8), the fill end (6) is automatically completely disengaged.

In the solution illustrated in FIGS. 3 and 4, designed for use in the case of stiff fill end, on the contrary, a short elastic blade (8') is used the side wall (9') of which cooperates with said wall (3') not throughout the whole length of the hollow (5) up to the apex (5') thereof, but, on the contrary, it just reaches a position (10) spaced apart from said apex (5'). In that way, the blade (8') does not clamp the fill end (6) but only acts as a barrier or shoulder to prevent the end (6') of the fill end (6) from rotating around its top lock clamping point (11) and according to the direction of arrow (12) (specifically see FIG. 4) and consequently getting released.

Finally, in the event when both fill ends (6) and (13) have to be driven simultaneously, the solution shown in FIGS. 5 and 6 is used which adopts a stack of three mutually superimposed elastic laminae (14), (15) and (16) having different lengths from each other, with said lengths increasing towards said apex (5'). In that way, the fill end (6) is clamped by the longest lamina (16) and the fill end (13) is clamped by the average-length lamina (15) and the shortest lamina (14), cooperating with the wall (3') of the hook (2) will prevent said fill ends (6') and (13') from getting released owing to a rotary movement.

We claim:

1. Fill end catching/clamping system in the fill drive clamp body of a loom, provided at one end with a hook, an axially movable wedge elastically urged inside said hook of the clamp body, said wedge positioned between a wall of said clamp body and a wall of said hook, said wall of said hook facing a wall of said wedge and forming a narrow "V"-shaped hollow for lock-clamping the fill end to be driven, characterized in that at least one elastic blade is positioned below said wedge and a side wall of said at least one elastic blade cooperates with said wall of said hook for retaining the fill end in said narrow "V"-shaped hollow.

2. Fill end catching/clamping system according to claim 1, wherein said "V"-shaped hollow has an apex, characterized in that said elastic blade extends along said "V"-shaped hollow, up to the apex of said "V"-shaped hollow.

3. Fill end catching/clamping system according to claim 1, wherein said "V"-shaped hollow has an apex, characterized in that said elastic blade extends along said "V"-shaped hollow, up to and beyond the apex of said "V"-shaped hollow.

4. Fill end catching/clamping system according to claim 1, wherein said "V"-shaped hollow has an apex, characterized in that said elastic blade is short and, extending along said "V"-shaped hollow, ends before reaching the apex of said "V"-shaped hollow.

5. Fill end catching/clamping system according to claim 1, characterized in that said elastic blade is supported by said axially movable wedge.

6. Fill end catching/clamping system according to claim 1, characterized in that said elastic blade is supported by the same clamp body.

7. Fill end catching/clamping system according to claim 1, wherein said "V"-shaped hollow has an apex, characterized in that said elastic blade is constituted by a stack of mutually superimposed elastic laminae having different lengths from each other, with said lengths increasing toward said apex of said "V"-shaped hollow.

* * * * *